United States Patent [19]

Miyamoto

[11] Patent Number: 4,958,188

[45] Date of Patent: Sep. 18, 1990

[54] IMAGE FORMING APPARATUS WITH ONE RESET SWITCH FOR RESETTING ONE TYPE OF TROUBLE AND A SECOND RESET SWITCH FOR RESETTING A SECOND TYPE OF TROUBLE

[75] Inventor: Hirohisa Miyamoto, Osaka, Japan

[73] Assignee: Minolta Camera Kabushiki Kaisha, Osaka, Japan

[21] Appl. No.: 290,218

[22] Filed: Dec. 27, 1988

[30] Foreign Application Priority Data

Dec. 28, 1987 [JP] Japan ..... 62-336321

[51] Int. Cl.[5] ..... G03G 21/00

[52] U.S. Cl. ..... 355/206; 355/205; 355/207

[58] Field of Search ..... 355/203, 204, 205, 206, 355/207, 208, 209, 200

[56] References Cited

U.S. PATENT DOCUMENTS

| | | | |
|---|---|---|---|
| 4,162,396 | 7/1979 | Howard et al. | 235/304 |
| 4,260,904 | 4/1981 | Horie et al. | 307/113 |
| 4,470,692 | 9/1984 | Shimizu et al. | 355/14 R |
| 4,500,971 | 2/1985 | Futaki et al. | 355/206 X |
| 4,583,834 | 4/1986 | Seko et al. | 355/206 |
| 4,627,711 | 12/1986 | Schron | 355/208 |

FOREIGN PATENT DOCUMENTS

| | | | |
|---|---|---|---|
| 0073638 | 6/1979 | Japan | 355/208 |
| 58-109926 | 6/1983 | Japan . | |

*Primary Examiner*—Arthur T. Grimley
*Assistant Examiner*—William J. Royer
*Attorney, Agent, or Firm*—Willian Brinks Olds Hofer Gilson & Lione

[57] ABSTRACT

An image forming apparatus which, when a trouble is detected, discriminates between a minor trouble and a serious one which may cause a high extent of damage and puts a copying operation in an inoperative state, so that in case of the minor trouble a first reset switch operable by an operator is operated to release the inoperative state and in case of the serious trouble a second reset switch operable by a maintenance staff is operated to release the inoperative state so as not to allow the operator to release the inoperative state caused by the serious trouble, thereby preventing aggravation of damage caused by the trouble.

9 Claims, 6 Drawing Sheets

IMAGE FORMING APPARATUS WITH ONE RESET SWITCH FOR RESETTING ONE TYPE OF TROUBLE AND A SECOND RESET SWITCH FOR RESETTING A SECOND TYPE OF TROUBLE

BACKGROUND OF THE INVENTION

1. Field of the Invention

The present invention relates to an image forming apparatus such as a copying machine or the like, which automtically detects the occurrence of trouble or inconvenience, and more particularly to a reset processing of the detected trouble thereof.

2. Description of Related Art

When various troubles (inconveniences) occur, for example, an abnormality in an optical system such that no scanning is performed with respect to an original, or in a driving system such that a main motor is not rotatable, the copying machine usually detects the trouble automatically to stop the copying operation. An operator clears the trouble according to the cause thereof and turns on a reset switch to release the copy stop state.

In such a copying machine, even when the operator does not clear the trouble according to the cause thereof but only turns on the reset switch, the copy stop state may be released to enable the copying operation. Such troubles include both relatively minor troubles such as temporary vibration that puts the scanning out of order, and serious troubles such as a high temperature abnormality at a fixing portion which may cause damage to the parts. Therefore, in a case where the trouble which may cause a serious damage to the copying machine is repeated and the reset switch is operated every time to release the copy stop state to continue the copying without searching for the cause of trouble, the corresponding parts are severely damaged to make the copying machine unusable, and may cause a fire.

SUMMARY OF THE INVENTION

The present invention has been designed in order to solve the above conventional problem.

A first object of the invention is to provide an image forming apparatus which discriminates between a minor trouble and a serious trouble and provides reset switches corresponding thereto, so that the reset switch for a serious trouble which may cause a heavy damage is disposed not to be operable by an operator, thereby preventing a breakdown caused by the trouble.

A second object of the invention is to provide an image forming apparatus which stores a serious trouble even when a power supply is cut off, and keeps the apparatus in the inoperative state even when the operator resets the apparatus against cutoff of power supply, thereby preventing a breakdown caused by the trouble.

A third object of the invention is to provide an inoperative state releasing method which discriminates between a minor trouble and a serious trouble that may cause a heavy damage, so that in case of the minor trouble the reset switch is operated to release the inoperative state, and in case of the serious trouble the reset switch is made inoperable, thereby preventing the serious trouble from being released by the operator and preventing aggravation of damage.

The above and further objects and features of the invention will more fully be apparent from the following detailed description with accompanying drawings.

DESCRIPTION OF THE PREFERRED EMBODIMENT

Figure 1:
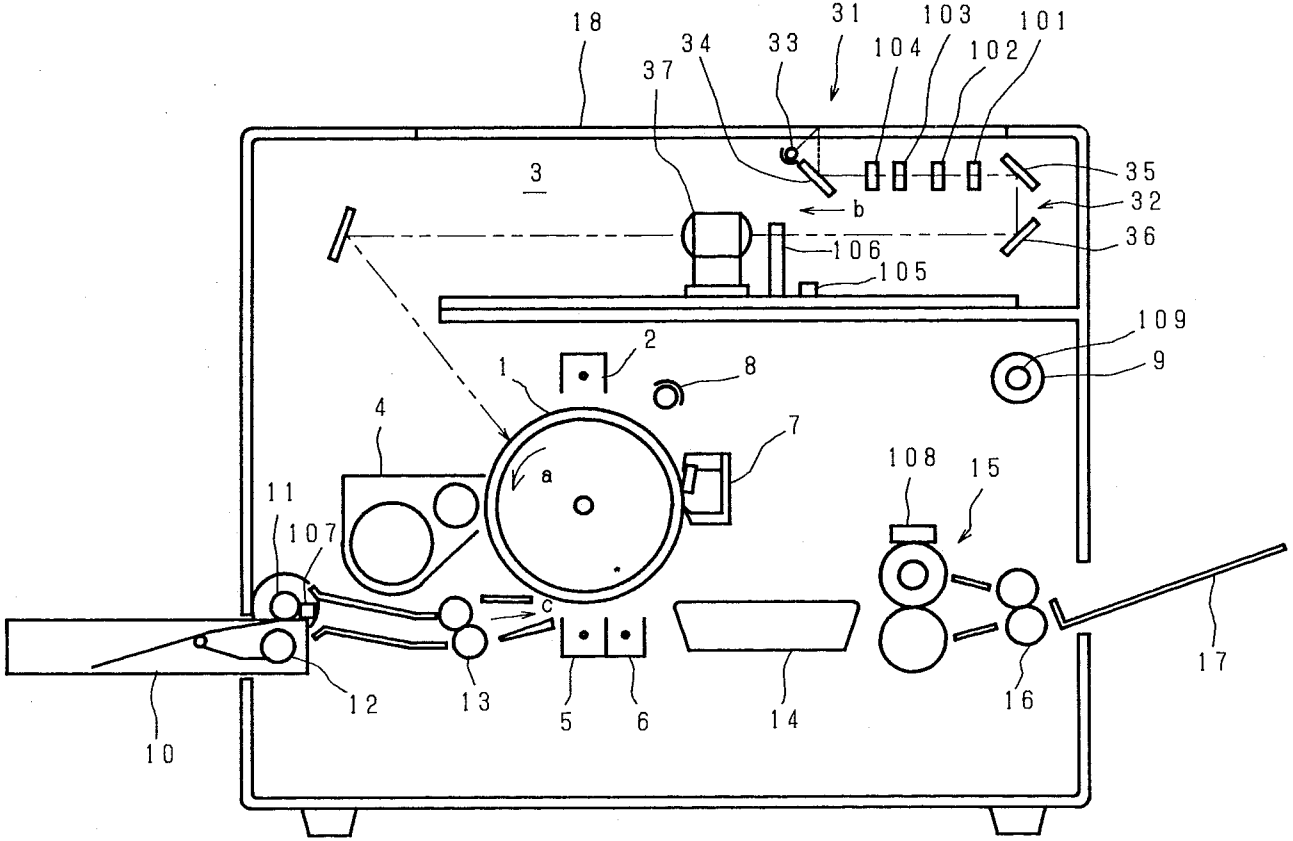
FIG. 1 is a typical view showing the internal construction of an image forming apparatus of the invention.

Next, the present invention will be concretely described in accordance with the drawings showing an embodiment thereof. FIG. 1 is a typical view showing the internal construction of a copying machine as an image forming apparatus, in which reference numeral 1 designates a photosensitive drum having a photoconductive layer at the outer periphery, which can be rotatably driven in the direction of the arrow a. An electrification charger 2 is disposed above the photosensitive drum 1 so as to apply to the surface thereof electric charge at predetermined potential (in this embodiment, positive polarity charge). An image exposure unit 3 is provided below a transparent original table 18. The image exposure unit 3 comprises a first slider 31 comprising an exposure lamp 33 scanning in the direction of the arrow b and a movable mirror 34, a second slider 32 comprising movable mirrors 35 and 36, and a lens 37, so that electrostatic latent images corresponding to original images placed on the original table 18 are formed on the surface of the photosensitive drum 1. Sensors 101, 102, 103 and 104 are disposed at the lateral side of the moving area of first slider 31 and control scanning by the first slider 31. The sensor 101 detects the reference position, the sensor 102 detects the lighting position of the exposure lamp 33, and the sensors 103 and 104 detect the brake position in enlarging/reducing.

Laterally of the lens 37 are disposed a sensor 105 for detecting the equal magnification position of the lens and an AE sensor 106 for determining the exposure value of the exposure lamp 33.

A developing device 4 is provided ahead of the charger 2 in the rotation direction of the photosensitive drum 1. The developing device 4 develops the electrostatic latent images formed on the surface of photosensitive drum 1 into toner images by use of the magnetic brush system. A transfer charger 5 is provided below the photosensitive drum 1, which applies the electric field to a copying paper (not shown here) being transported in the direction of the arrow c from the rear surface thereof so that the toner images formed by the developing device 4 on the surface of photosensitive drum 1 are transferred onto the copying paper. A separation charger 6 is provided adjacent to the transfer charger 5 in the rotation direction of photosensitive drum. The separation charger 6 applies an A.C. electric field to the copying paper just after transfer, thereby deenergizing the copying paper and peeling off the same from the outer surface of the photosensitive drum 1.

A cleaning device 7 is provided ahead of the separation charger 6 in the rotation direction of the photosensitive drum 1, which removes by a blade system the toner on the surface of photosensitive drum 1. An eraser lamp 8 is provided between the cleaning device 7 and the charger 2, which removes by light irradiation the residual electric charge on the surface of photosensitive drum 1 in order to stand by for a next copying operation.

Reference numeral 10 designates a cassette for containing therein the copying paper, which is detachably mounted to the body of the copying machine. The cassette 10 is provided with a paper feed roller 11 for delivering the copying paper and a lift-up motor 12 for lifting up the copying paper to the paper feed roller 11. In the vicinity of the paper feed roller 11 is disposed a sensor 107 for detecting the upper limit position of the copying paper lifted up by the lift-up motor 12. The copying paper delivered from the cassette 10 is delivered between the photosensitive drum 1 and the transfer charger 5 with the timing by timing rollers 13 in the direction of the arrow c. The copying paper transferred with the toner images thereon is delivered by a transport belt 14 to a fixing portion 15.

The fixing portion 15 melts and fixes the toner images on the copying paper by use of upper and lower fixing rollers each containing therein a heater. Above the upper roller is provided a thermister 108 for detecting the temperature of the roller. The copying paper on which the images are fixed is discharged by paper discharge rollers 16 onto a paper discharge tray 17.

Above the fixing portion 15 is provided a main motor 9 for rotatably driving the photosensitive drum 1 or the like, and the rotation of the main motor 9 is detected by a rotary encoder 109.

Figure 2:
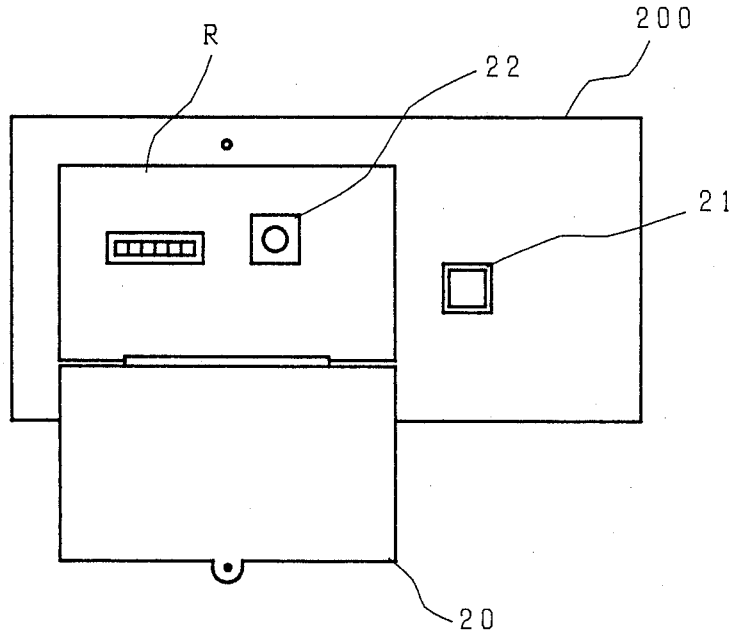
FIG. 2 is a view showing a reset operation panel of the image forming apparatus of FIG. 1.

FIG. 2 shows a reset operation panel 200 at which first and second reset switches 21 and 22 are provided. The panel 200 is located at, for example, the external portion positioned above the paper discharge tray 17. The first reset switch 21 is usually exposed on the outer surface of the copier so as to be easily operated by a user. A rectangular recess R is formed at the left side of first reset switch 21, and the seconnd reset switch 22 is provided in the recess R. A lid 20 covering the recess R is mounted thereto and usually seals the recess R by use of a screw bolt or the like, so that it is considered that the second reset switch 22 is operated not by the user but by a maintenance staff or the like.

Figure 3:
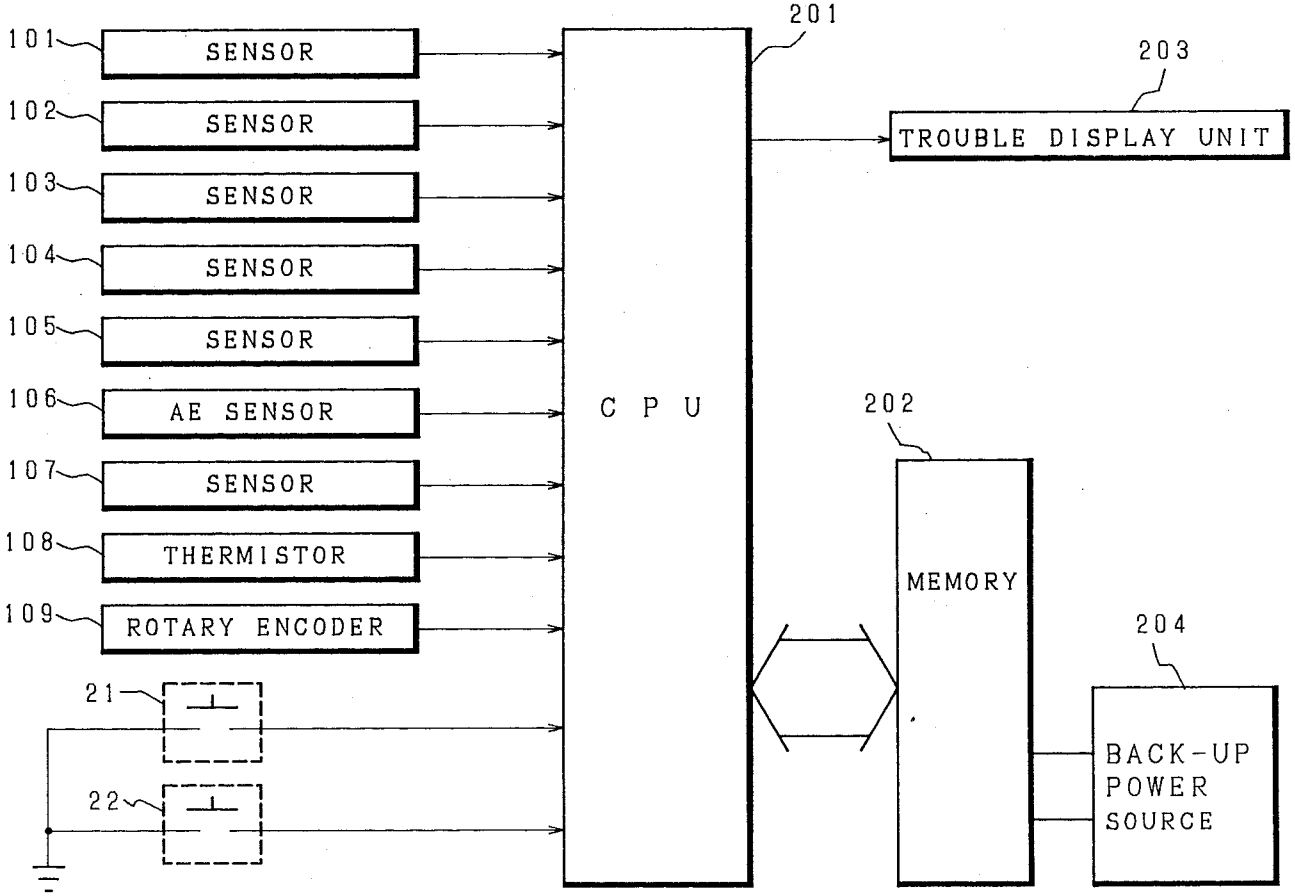
FIG. 3 is a block diagram of the principal portion of a control circuit of the image forming apparatus of FIG. 1, and FIGS. 4, 5(*a*) and 5(*b*) are flow charts showing the control procedure of the central processing unit (CPU) of the image forming apparatus of FIG. 1.

FIG. 3 is a block diagram of the principal portion of a control circuit of the apparatus of the invention. In a CPU (central processing unit) 201 which is a control center of the apparatus of the invention, detection signals from the respective sensors 101 through 107, thermister 108 and rotary encoder 109, etc. and on-off signals for the first and second reset switches 21 and 22 are inputted, and the sensors 101 through 107, thermister 108 and rotary encoder 109 detect a signal for control as to the copying operation, and they detect the trouble as well. In addition, the content of the trouble detection in the embodiment of the invention is merely illustrative. In actuality a large number of other well-known sensors as to the copying operation are also provided, by which various troubles can be detected.

The CPU 201 issues to a trouble display unit 203 an output signal corresponding to the content of the trouble detected by the sensors 101 through 107, thermister 108 and rotary encoder 109, and the trouble display unit 203 displays the content corresponding to the output signal.

A memory 202 is provided for storing therein a part of detection signal of the trouble inputted to the CPU 201, which and is connected to a back-up power source 204.

Next, explanation will be given on the control procedure by the CPU 201 with reference to the FIGS. 4, 5(*a*) and 5(*b*) flow charts.

Figure 4:
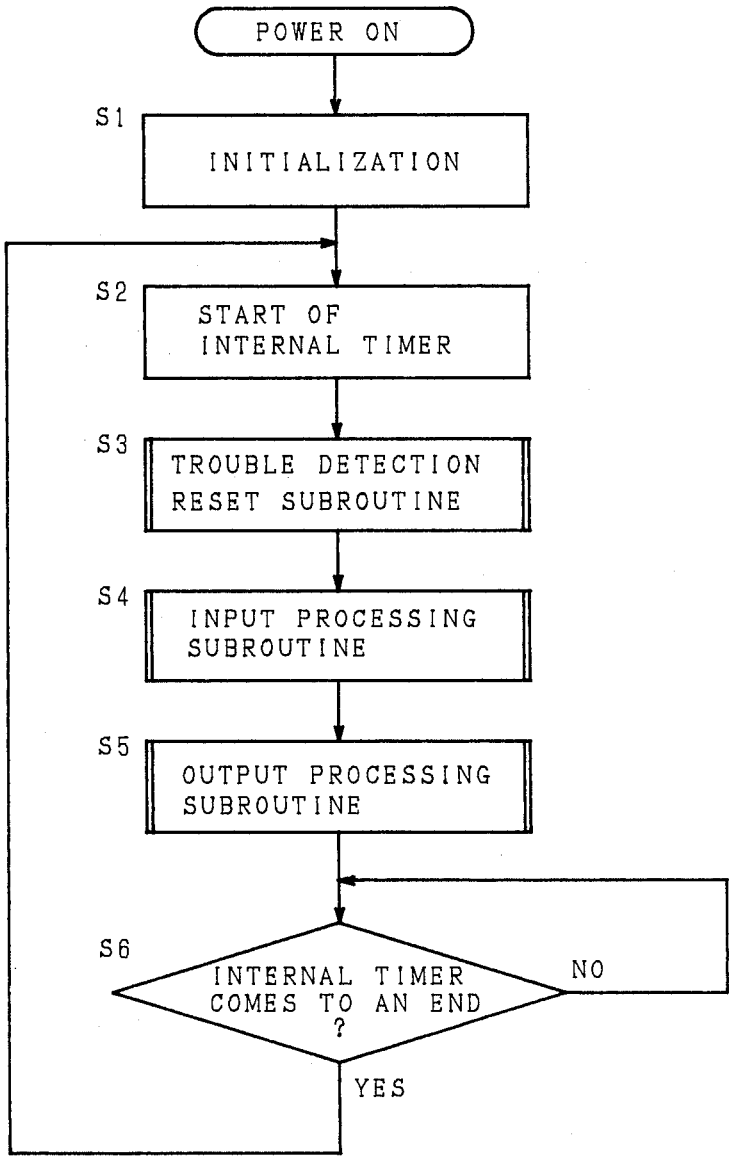

FIG. 4 shows a main flow of the CPU 201. When the power source is closed to reset the CPU 201 and then the program starts, in Step S1, the initial setting is carried out for initializing various registers and putting the respective units in the initial mode. Next, in Step S2, an internal timer starts. The internal timer serves to determine a required time for one routine of the main routine irrelevantly to the processing content in the subroutine to be described below and the value thereof is preset in Step S1 of initial setting.

Next, the subroutines shown in Steps S3 through S5 are sequentially called and when the processes of all the subroutines end, the internal timer end is awaited in Step S6 and then the processing returns to Step S2. Various timers, for example, the timer for sequence control of copying, used in the input and output process routine in Steps S4 and S5 are counted by use of a time period of one routine. The well-known control as to the copying operation is carried out in the input and output process routine.

Figure 5A:
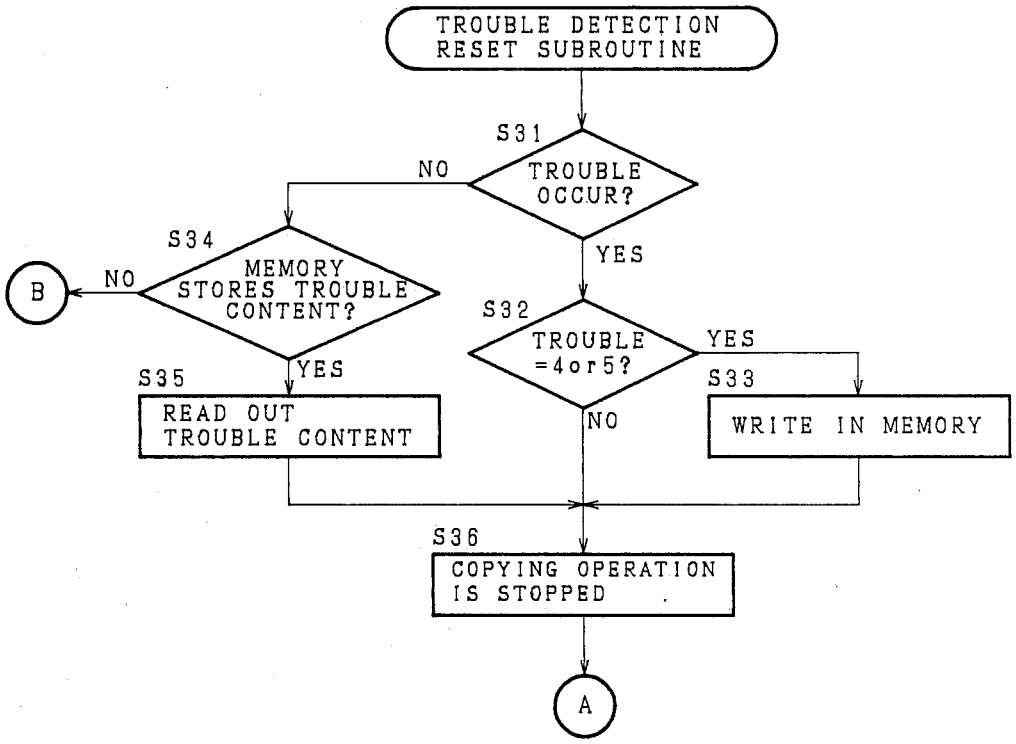
Figure 5B:
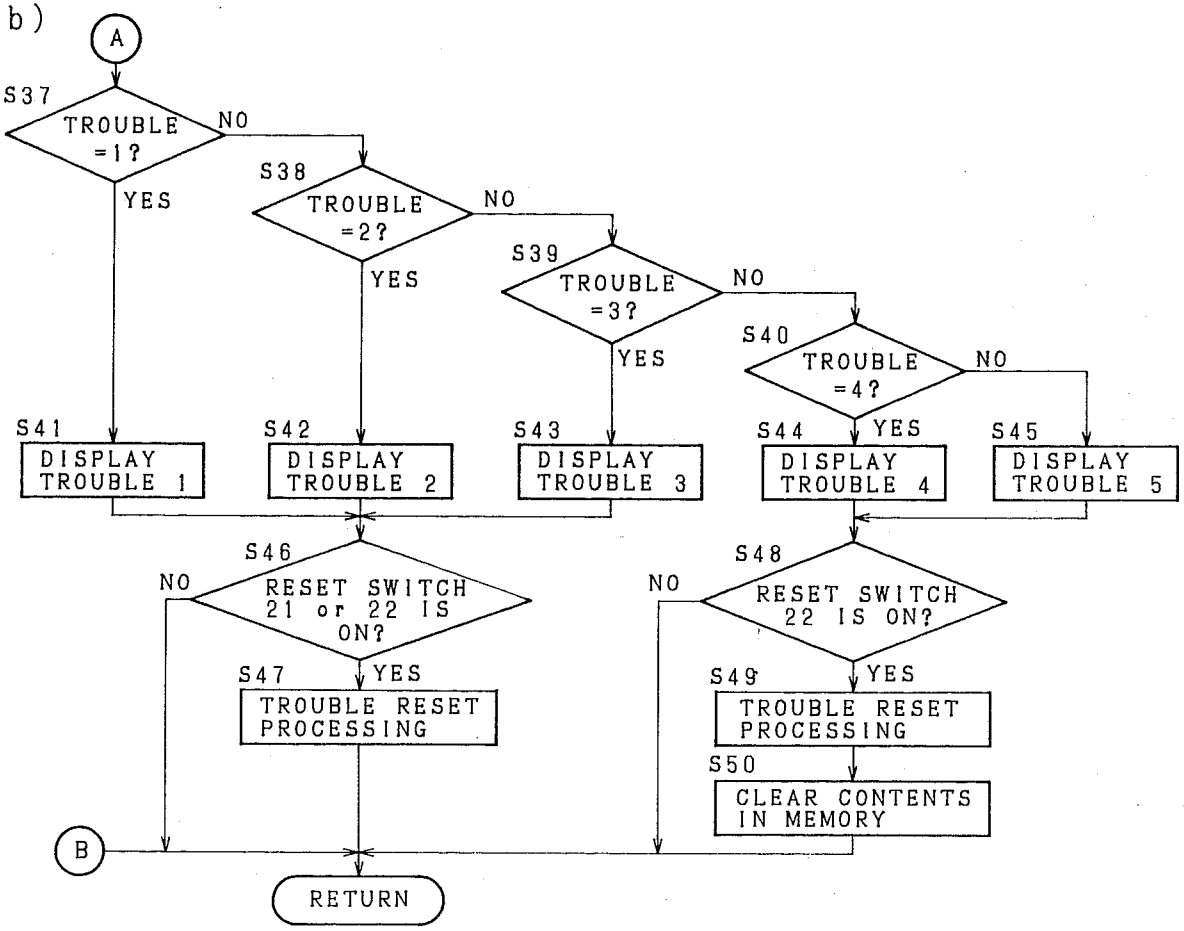

FIGS. 5(*a*) and 5(*b*) show the trouble detection reset subroutine in Step S3, wherein the numbers of 1 through 5 are allotted to each trouble detected by the sensors 101 through 107, thermister 108 and rotary encoder 109. In other words, the troubl 1 represents abnormality in the optical system, such as the first slider 31 and lens 37, detected by the sensors 101 through 105, the trouble 2 abnormality in the sensor 107, that is, the lift-up of paper feed at the paper feed cassette, the trouble 3 abnormality in driving of the main motor 9 detected by the rotary encoder 109, the trouble 4 abnormal lighting or disconnection of the exposure lamp 33 detected by the AE sensor 106, and the trouble 5 abnormality in the fixing temperature of the fixing portion 15 provided with the heater controlled by the detection signal of the thermister 108.

At first, in Step S31, the CPU determines whether or not trouble occurs. When it occurs, the CPU determines whether it is the trouble 4 or 5 in Step S32, and thereafter the copying operation is stopped in Step S36. When the occurring trouble is 4 or 5, the content thereof is written in the memory 202 in Step S33 and then the copying operation is stopped. Next, in Steps S37 through S40, the CPU determines if any one of trouble 1 through 5 occurs and the trouble is displayed in Steps S41 through S45.

When the trouble is 1 through 3, the CPU determines whether either the first reset switch 21 or the second reset switch 22 is on in Step S46. If on, the CPU releases the trouble reset process, that is, display of trouble and instruction of stopping the copying operation in Step S47, and then the processing returns to the main routine.

On the other hand, when the trouble is 4 or 5, the CPU determines whether or not the second reset switch 22 is on in Step S48, so that, when on, the CPU carries out the trouble reset processing in Step S49, and next, the CPU clears the stored contents in the memory 202 in Step S50 and the processing returns to the main routine.

In brief, the troubles 1 through 3 are relatively minor damage with respect to the copying machine, whereby as to these troubles, the first rest switch 21, that is, the trouble reset by the user can be performed.

On the other hand, the trouble 4 or 5 relates to the temperature or the like, and, when repeated, the extent of damage becomes high to result in a fear of fire. Therefore, these troubles can be reset only by the second reset switch 22, that is, only by the maintenance staff.

Now, after any trouble occurs, even when the reset switch is not operated, but the power supply switch is off, since the CPU 201 is set in the initial state, the trouble reset is performed. As a result, after the power supply switch is turned on again, in Step S31 the CPU determines that no trouble occurs, and the processing advances to Step S34, in which the CPU determines whether or not the memory 202 stores therein the trouble content. Even when the power supply switch is off, the back-up power source 204 holds the stored content in the memory 202. When the content of trouble 4 or 5 is stored, the CPU reads out the content in Step S35 and the copying operation is stopped as the same as the above-mentioned, and the content of trouble 4 or 5 is displayed in Step S36. When no trouble content is stored in the memory 202 in Step S34, the processing returns to the main routine and the copy control is continued.

In summary, when the trouble 4 or 5 occurs, since the user cannot perform the trouble reset by the first reset switch 21, he intends to once turn off the power supply switch to perform the trouble reset. However, since the content of the trouble 4 or 5, even when the power source is cut off, is stored in the memory 202, after the power source is turned on again, the content is read out and the copying operation is again stopped so as to display the trouble. Hence, when trouble of an high extent of damage with respect to the copying machine occurs, trouble reset by the user is impossible, thereby preventing aggravation of damage caused by the reoccurrence of the trouble. After the maintenance staff searches the cause and repairs the copying machine, he operates the second reset switch 22 to perform the trouble reset.

In addition, in this embodiment, both the first and second reset switches 21 and 22 perform the trouble reset for the troubles 1 through 3, which may be performed only by the first reset switch 21. Also, the arrangement of second reset switch 22 is not limited to that of the embodiment and need only be not easily operable by the user. Alternatively, for example, instead of providing the second reset switch 22, when a predetermined code is inputted on the operation panel, the first reset switch 21 may have the trouble reset function of second reset switch 22.

As seen from the above, the copying machine of this embodiment selects various occurring troubles according to an extent of damage so that the user can perform the trouble reset as to the trouble of low probability of damage and the maintenance staff or the like not the user searches the cause of trouble and certainly repairs it and thereafter carries out the trouble reset, thereby preventing aggravation of damage caused by the trouble.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An image forming apparatus comprising:

image processing means including a plurality of discrete operating elements cooperable with one another;

trouble detecting means for detecting trouble occurring in each of said elements;

apparatus stop means for putting said apparatus in an inoperative state when said trouble is detected;

a first switch operable by an operator;

a second switch provided at a different position from said first switch;

discriminating means for discriminating between a first kind of said trouble and a second kind thereof; and releasing means for releasing said inoperative state in response to said first switch when said first kind of trouble occurs, and for releasing said inoperative state in response to said second switch when said second kind of trouble occurs.

2. An image forming apparatus as set forth in claim 1, wherein said second switch is operated by a maintenance staff.

3. An image forming apparatus as set forth in claim 1, further comprising;

a power switch for supplying and cutting off electric power to said apparatus;

storage means for storing therein the occurrence of said second kind of trouble;

first control means for putting said apparatus in the inoperative state in the case where said second kind of trouble is stored in said storage means when said power switch is closed; and second control means for clearing said storage means in response to said second switch.

4. An image forming apparatus comprising;

image processing means including a plurality of discrete operating elements cooperable with one another;

trouble detecting means for detecting trouble occurring in each of said elements;

apparatus stop means for putting said apparatus in an inoperative state when said trouble is detected;

a releasing switch being operable by an operator;

discriminating means for discriminating between a first kind of said trouble and a second kind thereof; and releasing means for releasing said inoperative state in response to said releasing switch when said first kind of trouble occurs, and for making said releasing switch inoperable when said second kind of trouble occurs.

5. A method of releasing the inoperative state for an image forming apparatus which comprises image processng means including a plurality of discrete operating elements cooperable with one another, trouble detecting means for detecting trouble occurring in each of said elements, apparatus stop means for putting said apparatus in an inoperative state when said trouble is detected, and a releasing switch operable by an operator, said method comprising the steps of;

discriminating between a first kind of said trouble and a second kind thereof;

releasing said inoperative state in response to said releasing switch when said first kind of trouble occurs; and making said releasing switch inoperable when said second kind of trouble occurs.

6. A controlling method for an image forming apparatus which comprises image processing means including a plurality of discrete operating elements cooperable with one another, trouble detecting means for detecting trouble occurring in each of said elements, and apparatus stop means for putting said apparatus in an inoperative state when said trouble is detected, said method comprising the steps of;

discriminating between a first kind of said trouble and a second kind thereof;

inputting a first release instruction;

releasing said inoperative state in response to said first release instruction when said first kind of trouble occurs;

inputting a second release instruction; and releasing said inoperative state in response to said second release instruction when said second kind of trouble occurs.

7. An image forming apparatus comprising:

image processing means including a plurality of discrete operation elements cooperable with one another;

trouble detecting means for detecting trouble occurring in each of said elements;

apparatus stop means for putting said apparatus in an inoperative state when said trouble is detected;

a first switch operable by an operator, said first switch provided at an operator accessible place;

a second switch provided at a place where said operator is hard to access;

discriminating means for discriminating between a first kind of said trouble and a second kind of said trouble; and releasing means for releasing said inoperative state in response to said first switch when said first kind of trouble occurs, and releasing said inoperative state in response to said second switch when said second kind of trouble occurs.

8. An image forming apparatus as set forth in claim 7, further comprising:

cover means for covering said second switch such that said second switch is hard to access by the operator.

9. An image forming apparatus as set forth in claim 8, wherein said cover means is fixed to a housing of the apparatus by a screw.

* * * * *

UNITED STATES PATENT AND TRADEMARK OFFICE

CERTIFICATE OF CORRECTION

PATENT NO. : 4,958,188

DATED : September 18, 1990

INVENTOR(S) : Hirohisa Miyamoto

It is certified that error appears in the above-identified patent and that said Letters Patent is hereby corrected as shown below:

In col. 1, line 12, change "automtically" to --automatically--.

In col. 3, line 1, before "toner", insert --residual--.

In col. 4, line 1, delete "which".

In col. 4, line 31, change "troubl" to --trouble--.

In col. 5, line 1, change "rest" to --reset--.

In col. 5, line 21, delete "as" (first occurrence).

Signed and Sealed this

Thirty-first Day of March, 1992

*Attest:*

HARRY F. MANBECK, JR.

*Attesting Officer*

*Commissioner of Patents and Trademarks*